US005421906A

United States Patent [19]

Borah

[11] Patent Number: 5,421,906

[45] Date of Patent: Jun. 6, 1995

[54] METHODS FOR REMOVAL OF CONTAMINANTS FROM SURFACES

[75] Inventor: Ronald E. Borah, Chesterton, Ind.

[73] Assignee: EnClean Environmental Services Group, Inc., Bellaire, Tex.

[21] Appl. No.: 43,435

[22] Filed: Apr. 5, 1993

[51] Int. Cl.[6] ..... B08B 3/08; C11D 7/08; C23G 1/2

[52] U.S. Cl. ..... 134/26; 134/3; 134/28; 134/41; 252/142; 252/174.16; 252/546

[58] Field of Search ..... 134/3, 26, 28, 41; 252/142, 174.16, 174.19, 546, 548

[56] References Cited

U.S. PATENT DOCUMENTS

| | | | |
|---|---|---|---|
| 3,437,521 | 4/1969 | Buist | 134/26 |
| 3,832,234 | 8/1974 | Otrhalek et al. | 134/4 |
| 3,957,529 | 5/1976 | Alexander et al. | 134/3 |
| 4,032,466 | 6/1977 | Otrhalek et al. | 134/41 X |
| 4,040,866 | 8/1977 | Mondshine | 134/26 |
| 4,174,290 | 11/1979 | Leveskis | 134/3 |
| 4,376,069 | 3/1983 | Maggi | 252/542 |
| 4,390,465 | 6/1983 | Spekman, Jr. | 252/527 |
| 4,410,396 | 10/1983 | Somers et al. | 156/664 |
| 4,430,128 | 2/1984 | Frenier et al. | 134/3 |
| 4,439,339 | 3/1984 | Doumit | 134/41 X |
| 4,472,205 | 9/1984 | Cortner | 134/27 |
| 4,541,945 | 9/1985 | Anderson et al. | 252/149 |
| 4,640,719 | 2/1987 | Hayes et al. | 134/42 X |
| 4,666,528 | 5/1987 | Arrington et al. | 134/28 X |
| 4,749,508 | 6/1988 | Cockrell, Jr. et al. | 252/136 |
| 4,762,638 | 8/1988 | Dollman et al. | 134/3 X |
| 4,792,413 | 12/1988 | Nash et al. | 252/111 |
| 4,877,459 | 10/1989 | Cockrell, Jr. et al. | 134/40 |
| 5,102,573 | 4/1992 | Han et al. | 252/153 |
| 5,122,194 | 6/1992 | Miller et al. | 134/29 |

OTHER PUBLICATIONS

Conner, Jesse R., "Chemical Fixation and Solidification of Hazardous Wastes," 1990, pp. 36–39; 43; 55; 72–74; 91; 380–381; and 533.

Adamson, Arthur W., "Physical Chemistry of Surfaces," 5th Ed., 1990, pp. 11; 101; 226–227; 229; 379; 421–422; 435; 442–443; 473; 493–495; 506–507; 514–516; 528; 531; and 571.

Rosen, Milton J., "Surfactants and Interfacial Phenomena," 2nd Ed., 1989, pp. 17–19; 31; 55–56; 150; 229; 255; 270–273; and 374–375.

Manaham, Stanley E., "Environmental Chemistry," 5th Ed., 1991, pp. 5; 48–49; 57; 59; 67–68; 96—96; 162–163; 172–175; 198; 260–261; 415; 433–434; and 481.

*Primary Examiner*—Michael Lewis
*Assistant Examiner*—Saeed T. Chaudhry
*Attorney, Agent, or Firm*—Pravel, Hewitt, Kimball & Krieger

[57] ABSTRACT

A cleaning process and water-based cleaning compositions effective for the removal of radionuclides, polychlorinated biphenyls, pesticides, herbicides, and heavy metals from surfaces of all types, more especially porous surfaces, surfaces that contain irregularities and microscopic voids into which contaminants may migrate and lodge thereby creating a substrate below the surface that must also be cleaned, and particulate surfaces. The cleaning blends and processes remove contaminants from porous and irregular surfaces to such a depth below the surface and into the substrate, and to such an extent, that the cleaned surface satisfies current regulations promulgated by the EPA and NRC relating to standards for decontamination. The process also allows sealing of cleaned surfaces, if desired, with an impermeable coating of a synthetic polymeric composition in order to retard subsequent migration of any residual contaminants to the surface.

18 Claims, No Drawings

METHODS FOR REMOVAL OF CONTAMINANTS FROM SURFACES

BACKGROUND OF THE INVENTION

1. Field of the Invention

The invention is of a cleaning process and cleaning compositions effective for the extraction of contaminants including radionuclides, herbicides, pesticides, polychlorinated biphenyls (PCBs), and heavy metals from interior and exterior surfaces, including the substrate of such surfaces, and is most effective in cleaning difficult to clean surfaces such as porous surfaces, and irregular surfaces into which the contaminants may migrate and lodge, and surfaces of particulates. Cleaning is effected to such a depth below the surface and into the substrate and to such an extent that the cleaned surfaces do not pose an environmental or health hazard and meet current regulations promulgated by the Environmental Protection Agency (EPA) and Nuclear Regulatory Agency (NRC) relating to standards for decontamination.

2. Description of the Related Art

With the growth of industry, a significant amount of hazardous waste products and products formerly regarded as useful but now recognized as hazardous have entered the environment. These hazardous materials are frequently present as contaminants on surfaces of equipment, installations of all kinds, civil works, soil, and other like items.

For example, a significant amount of radioactive waste, in the form of radionuclides, is present in nuclear power plants, nuclear weapons production plants, mining and milling equipment used for uranium mining, and in apparatus in the medical area where radioactive isotopes are used. The presence of these radionuclides, which contaminate equipment including pumps, pipelines, valves, concrete foundations, and all other equipment and structures with which the radionuclides have come into contact, now pose a serious health problem since their radioactivity is known to be carcinogenic. To qualify as a decontaminated facility, the EPA requires that the level of radioactivity from radionuclides be reduced to less than 2,000 disintegrations per minute (DPM).

Polychlorinated biphenyls (PCBs) were once widely used industrial chemicals, especially as insulating or hydraulic fluids in electrical capacitors, transformers, vacuum pumps, gas-transmission turbines, machinery, and various other devices and products. Their chemical stability and nonflammability contributed to their commercial usefulness. However, it has since been found that PCBs are carcinogens and the United States Environmental Protection Agency (EPA) currently lists PCBs and any surfaces or equipment containing PCBs as hazardous. Consequently, these chemicals are no longer recommended or used in new applications. However, a large amount of existing capital equipment, installed before the listing of PCBs as hazardous, contains PCBs. These installations pose a hazard whenever a spillage of PCBs occurs thereby contaminating the surrounding area or whenever routine repairs expose workers or the environment to PCBs.

While it is desirable to remove PCBs and dispose of these in a suitable hazardous waste facility, PCBs are not easily removed from apparatus or spilled areas because of their capability to enter into the tiniest of pores and microscopic voids and spaces in surfaces with which they come into contact. For example, in transformers which frequently contain wood, paper, metal joints, and electrical components with minute crevices, the PCBs soak into pores and microscopic voids in the steel and concrete and fill the tiniest of microscopic spaces such as pores and microscopic voids, and the like, in metals. When PCBs have spilled onto a surface, such as a concrete surface, the PCBs over time will soak into pores and microscopic voids in the concrete and contaminate the concrete to well below the exposed surface. Current techniques that merely clean the surface of concrete that has been exposed to the PCBs for a long period of time are not able to adequately clean the surface and do not reach PCBs held in the substrate below the surface in the pores and microscopic voids. Moreover, once surface cleaning has been completed, PCBs leach from the pores and microscopic voids to the surface over time due to the effect of a concentration gradient. Thus, the surface becomes recontaminated and further cleaning is necessitated. Likewise, while the bulk of the PCBs can be readily drained from some PCB-containing equipment, the residual PCB contaminant in pores, microscopic voids, crevices, and joints is not easily removed. It is found that upon refilling the drained apparatus with a replacement fluid for PCBs, PCBs will continue to leach from surfaces of the apparatus into the replacement fluid thereby contaminating it and rendering it hazardous.

Likewise, heavy metals have been identified as hazardous to human health and the EPA requires their removal from environments where they pose a health hazard. Like PCBs and radionuclides, heavy metals have the capability to migrate into pores, joints, crevices, and microscopic voids in interior and exterior surfaces and thereby cause contamination in the substrate to well below the apparent surface of any apparatus, device, or ground surface with which they come into contact. Mere surface cleaning is therefore ineffective to remove heavy metals contamination from substrates.

Certain pesticides and herbicides are also now known to be hazardous to human health. These compositions contaminate surfaces and substrates, such as concrete, but more especially particulate surfaces, such as soil, clay, gravel, and the like.

There is a need for methods and cleaning compositions for the removal of contaminants including radionuclides, PCBs, herbicides, pesticides, and heavy metals from porous and non-porous interior and exterior surfaces, particulate surfaces, and surfaces having minute spaces, crevices, pores, or microscopic voids into which these contaminants migrate and from which they are not readily extractable. Further, the method and cleaning compositions should desirably not only extract these contaminants from well below the surface to be cleaned, but should extract these to such a level that any remaining contaminants do not pose a hazard, i.e., a surface and its substrate cleaned of PCBs would meet EPA regulations for reclassification from a hazardous to a non-hazardous material; a surface and its substrate cleaned of heavy metals, herbicides, or pesticides, would meet the EPA's TCLP standard setting the upper limit for their concentration; and a surface and its substrate cleaned of radionuclides would test at less than 2,000 DPM. The method and cleaning compositions should also desirably extract these contaminants without significant surface damage or scarring. Further, the method and cleaning compositions should desirably extract these contaminants with a minimum amount of hazardous waste byproduct which must be disposed of and, in the case of radionuclides, the byproduct waste should preferably be water soluble to assist in ease of disposal. Finally, cleaning compositions should desirably not be flammable.

SUMMARY OF THE INVENTION

The invention provides water-based, non-flammable cleaning compositions and methods for applying these compositions for the extraction of contaminants such as radionuclides, herbicides, pesticides, polychlorinated biphenyls (PCBs), heavy metals, and other hazardous compositions including those listed as hazardous under the U.S. EPA's TCLP standard, or mixtures thereof, from surfaces and substrates of all kinds. While the invention cleans smooth surfaces easily, it is especially useful in cleaning hard to clean surfaces and substrates, such as surfaces having porous surfaces, and surfaces with irregularities or microscopic voids. The invention also cleans particulate surfaces and the particulates. While it is usually difficult, if not impossible, using prior art techniques to remove these contaminants to acceptable regulatory levels from these hard to clean surfaces, particularly where the contaminants have remained on the surface for long periods of time thereby permitting deep migration of the-contaminants into the substrate, the invention cleaning compositions and processes are particularly effective for removing contaminants from these surfaces and their substrates.

Generally, "porous surfaces" include steel (including stainless steel, mild steel, and galvanized steel) cast iron, concrete, brick, wood, and the like. "Surfaces with irregularities" include surfaces that are not porous in the conventional sense but that contain minute spaces, crevices, pores, microscopic voids, surface irregularities, and restricted spaces into which the contaminants migrate and lodge and thereby create a contaminated substrate below the surface that must also be cleaned. The invention also cleans contaminants from surfaces of particulates, such as sand, clay, gravel, and the like.

The invention cleaning fluids and processes are effective in removing contaminants from surfaces and their substrates and providing a cleaned surface that meets the standards currently set by the U.S. EPA. The term "contaminants" as used in the specification and claims encompasses radionuclides, PCBs, herbicides, pesticides, heavy metals, including, without limitation, all those materials and compositions listed as hazardous and that have the characteristic of toxicity under 40 C.F.R. § 261.24 (Table 1) (Revised as of July 1992 and hereby incorporated by reference as if fully set forth herein), and like compositions, and also materials that pose an undesirable contaminant and that desirably must be reduced in concentration to an acceptable level.

The invention cleaning fluids and processes are capable of extracting contaminants from beneath porous surfaces and the substrate, without significant surface destruction. As a result, the cleaned surface is able to meet current regulatory standards for delisting. Since the process does not require the shaving, scarring, or scabbling of the surface to be cleaned as in prior art techniques, the surface is not substantially damaged or scarred. This is particularly advantageous in the cleaning of contaminated structural equipment, supporting foundations, or equipment to be reused.

The invention process requires at least two stages: a first precleaning stage to prepare the surface to be cleaned; and a second cleaning or extraction stage for removing the contaminants from the surface. The first stage utilizes a precleaning composition, a blend of chemicals, to initially scrub the surface and remove surface contaminants and dirt. Thereafter, the surface is rinsed with water substantially free of polyvalent cations. A suitable and preferred rinsing solution is a solution of 4–8 wt. % sodium citrate in distilled water or other water substantially free of ions. The precleaning scrubbing and rinsing steps are repeated, as needed. After each precleaning, the precleaned surface is vacuumed to remove fluid and debris as far as possible and thereby remove contaminants. Also, after each rinsing, the surface is vacuumed to remove the rinse fluid with contaminants. After-rinsing and vacuuming, the second stage, utilizing an extraction composition that is also a blend of chemicals, is applied by scrubbing the surface, allowing the extraction composition to dwell on the surface for a period of time. Thereafter, the surface is rinsed with a solution of sodium citrate in substantially ion-free water. The rinse fluids are again removed by vacuuming to remove the rinse fluid with contaminants. The application of the extraction composition, rinsing, and vacuuming may be repeated several times before a longer dwell time of the extraction composition on the surface. This dwell time may include an overnight or weekend dwell, if necessary, followed by rinsing with a solution of sodium citrate in substantially ion-free water. This rinse solution is preferably also removed by vacuuming to remove the fluid with contaminants.

The invention provides a method for removing contaminants from surfaces and substrates of such surfaces, including porous surfaces and surfaces with irregularities in which contaminants may migrate or lodge. The method includes precleaning the surface with an aqueous precleaning fluid; rinsing the precleaned surface with a fluid selected from the group consisting of: water substantially free of ions, and a solution of at least about 4 wt. % sodium citrate; applying to the rinsed surface an aqueous extraction fluid; allowing the applied extraction fluid to dwell on the surface for a time sufficient to penetrate into pores and microscopic voids or irregularities in the surface to extract the contaminants; and washing the extraction fluid from the surface to produce a cleaner surface.

The complete cycle of precleaning by scrubbing on precleaning fluid, and then rinsing followed by vacuuming, the applying of extraction fluid, dwelling of extraction fluid on the surface, rinsing of extraction fluid from the surface, vacuuming, followed by at least one longer dwelling of the extraction fluid on the surface, rinsing and vacuuming are repeated until the desired level of residual contaminants as dictated by the EPA regulations or other requirements (if not regulated by the EPA) are obtained. Optionally, this may be followed by applying a synthetic polymeric composition to form an impermeable barrier over the surface. Such coatings are produced, for example, by applying liquid polyurethane solutions by spraying or brushing onto the surface to be coated and sealed.

The precleaning and extraction blends are both water-based. To avoid interference from ions normally present in typical water supplies, it is preferred that the water used in making the precleaning and extraction blends be distilled, deionized, or demineralized in order to remove or significantly reduce the ion content of the water.

The cleaning compositions utilized are not flammable and the waste generated during cleaning generally constitutes less than about 7–8 gallons/100 $ft^2$ of surface cleaned. Therefore, waste disposal costs are minimized.

The invention cleaning process and cleaning compositions can reduce PCB contamination to less than 10 micrograms per 100 square centimeters (10 $\mu g/100\ cm^2$) of treated surface or "non-detectable, " i.e., 0.2 $\mu g/100\ cm^2$, so that the cleaned apparatus, structure, or other previously contaminated surface, may be reclassified under EPA regulations from a hazardous material to a non-hazardous material. Similarly, heavy metals are removed to a surface concentration of less than current EPA TCLP regulatory levels (40 C.F.R. § 261.24 as revised Jul. 1, 1992) for each of the listed heavy metals; and radionuclides can be reduced to surface concentrations of less than about 2,000 DPM (disintegrations per minute) or to a non-detection limit. Herbicide and pesticide levels are reduced to a surface concentration of less than current EPA TCLP regulatory levels for each of the listed herbicides and pesticides.

As a result of the invention's low level of residual contamination and deep cleaning, to a significant depth below the surface and into its substrate, the cleaned equipment or structures may be reclassified (under current federal regulations) as a non-hazardous substance, or disposed of as non-hazardous or reclassified for reuse or resale.

DETAILED DESCRIPTION OF THE PREFERRED EMBODIMENTS

The invention provides a cleaning process and cleaning fluid blends for removing contaminants such as, for example, radionuclides, herbicides, pesticides, PCBs, and heavy metals from interior and exterior surfaces of all types, including the substrates of such surfaces. The invention is particularly effective for removing contaminants from porous surfaces and surfaces that are conventionally regarded as non-porous but that may contain minute spaces, crevices, pores, microscopic voids, or other surface irregularities and restricted spaces into which these contaminants migrate and lodge and thereby create a substrate below the surface that must also be cleaned. For simplicity, these latter "conventionally non-porous" surfaces are hereinafter referred to as "surfaces with irregularities" or "surface irregularities." The invention removes the contaminants from porous materials and surfaces with irregularities to a significant depth beneath the surface so that current regulatory standards for decontamination are substantially achieved. Thereafter, the surfaces may be sealed with a synthetic polymeric composition, such as with a polyurethane coating in order to retard subsequent migration of the contaminants. The invention process and cleaning fluids can also be used to remove contaminants from particulates such as sand, clay, gravel, and the like.

The invention process and cleaning fluids can decontaminate radionuclide contaminated materials to less than the EPA-required 2,000 DPM (disintegrations per minute) standard. Heavy metals-contaminated materials and herbicide or pesticide-contaminated materials can be cleaned to meet or better the EPA's current TCLP standards. The invention process and cleaning fluids can also produce surfaces decontaminated of PCBs that meet current EPA standards: less than 10 micrograms/100 $cm^2$ to allow reclassification from a hazardous material to a non-hazardous material; and 0.2 micrograms/100 $cm^2$ to allow reuse or resale of PCB-decontaminated articles.

The invention cleaning blends are water-based and, to prevent interference from ions normally present in a typical water supply, it is preferred that the water be distilled, deionized, or demineralized to remove interfering ions and provide substantially ion-free water. As a precaution, it is also recommended that any rinsing or washing with water should likewise be carried out with water that is substantially ion-free.

The Process for Removing Contaminants

While not wishing to be bound by any theory, it is hypothesized that the invention process and cleaning compositions may perform their function by interaction of basic electro-chemical processes. Contaminated surfaces are usually negatively charged. Therefore, the positive ion-containing cleaning solutions are attracted to the surface by electrostatic effects and attracted into pores and microscopic voids and crevices by both electrochemical effects and electrocapillary forces. Further, the cations in the extraction solutions react electrochemically with contaminants to solubilize, or leach them out.

a. Smooth Surfaces or Irregular Surfaces

Before applying the precleaning solution to a smooth surface or a surface with irregularities, it is preferred that the contaminated surface should be swept, vacuumed, or lightly scraped to remove any loose surface debris, dirt, and the like.

The invention process requires a first application of a precleaning fluid to a contaminated surface, removal of the precleaning fluid by rinsing with a solution of sodium citrate in substantially ion-free water. This process may be repeated several times before an invention extraction fluid is applied.

The precleaning solution may be applied by any conventional means, including spraying by pressurized sprayer, pouring, scrubbing on, and like methods. To facilitate removal of loosely-held surface debris and contaminants, it is preferred that the precleaning solution be scrubbed onto the surface. After thorough scrubbing, the major portion of any surface-held debris or contaminants is removed along with the precleaning solution. The removal of the precleaning solution may be carried out by rinsing the surface in a solution of sodium citrate in substantially ion-free water. Thereafter, the surface should be vacuumed to remove loose debris and contaminants in the rinse fluid.

The precleaned, rinsed, vacuumed, and dried surface is now suitable for receiving the extraction solution. The extraction solution may be applied by spraying with pressurized sprayers, pouring, scrubbing on, and like methods or through circulation. Preferably, but not in all cases, the extraction solution is applied using a scrubbing technique. This ensures the removal and loosening of any further surface-held debris and contaminants while also facilitating the penetration of the fluid into the substrate through the pores, microscopic voids, and other surface irregularities in the surface. This penetration of the extraction fluid permits the leaching of contaminants from these surface irregularities and pores and microscopic voids so that deep extraction can be achieved.

The extraction stage is typically repeated several times and in each step the extraction fluid is allowed to dwell on the surface for at least about 1 to about 1.5 hours. Thus, in a typical clean-up process, extraction fluid is scrubbed onto the precleaned surface; allowed to dwell for about 1 to about 1.5 hours to allow leaching of contaminants from pores and other surface irregularities in which contaminants lodge; rinsed off with a solution of sodium citrate in substantially ion-free water which is then vacuumed from the surface; and the process is repeated by scrubbing extraction fluid onto the surface, etc. At the end of the working day, it is strongly preferred that the extraction fluid be scrubbed on and allowed to dwell on the surface overnight, i.e., for about 8 to about 13 hours. At least one such long dwell time is recommended. For especially heavily contaminated surfaces or porous surfaces, or surfaces with irregularities, it may be necessary to allow the extraction solution to dwell on the surface for a weekend—i.e., about 30 to about 60 hours. In general, a dwell time of between about 1 to about 100 hours is recommended, depending upon the nature of the surface, the type of contaminant, and the degree of contamination. When cleaning is recommenced in the morning after dwelling of extraction fluid on the surface overnight or over a weekend, then after rinsing off the extraction fluid and vacuuming off the rinse fluid, it is preferred that precleaning fluid is once again applied to the surface. After rinsing off the precleaning fluid and vacuuming the surface, the cycle of applying extraction fluid and dwelling of this fluid on the surface is recommenced, until the desired level of surface decontamination is achieved.

Clearly, the length of dwell time is dependent upon the surface being cleaned, the nature and concentration of contaminants being extracted and the ability to scrub the surface involved. The greater the degree of contamination and porosity of the surface or the more surface irregularities, the longer the required dwell time. A relatively smooth, lightly contaminated, pore-free surface, on the other hand, would require shorter dwell times. Preferably, the extraction fluid is allowed to dwell upon the surface at least once for a period of from about 8 to about 13 hours.

After a sufficient dwell time has elapsed to allow extraction of a significant portion of the contaminants, the surface is rinsed with a solution of sodium citrate in substantially ion-free water to remove the extraction fluid from the surface. Samples of the surface may then be tested to ascertain the concentration of residual contaminants. If the residual contaminant concentration is still unacceptably high, then the entire cleaning cycle, i.e., the application of both the precleaning and extraction fluids with necessary rinsing, dwell time, and vacuuming should be repeated until an acceptably low residual level of contaminants is achieved.

When the contaminant to be removed is heavy metals, the invention can remove up to about 90% of the contamination from a surface in a first application of the process steps. Each subsequent application of the invention process continues to remove up to about 90% of the then remaining contamination from the surface. Similarly, a first application of the invention method and fluids can result in a reduction of from about 80% to about 90% of the total radionuclide count. Each subsequent application of the invention process can continue to remove up to 80% to 90% of the then remaining contamination from the surface. When the contaminant is a pesticide or herbicide, the process can reduce residual levels to a level that meets TCLP standards (if it is a listed composition) or levels that are deemed acceptable (if it is not listed).

When the contaminant to be removed is PCBs, then the invention method can remove up to about 90% of the contamination from a surface in a first application of the process steps. Each subsequent application of the invention process can continue to remove up to about 90% of the then remaining contaminants. Through the multiple application of the invention process, the contaminants can be reduced to less than 10 $\mu g/100\ cm^2$ (meeting the EPA's standard for reclassification as non-hazardous) or a level that is non-detectable (i.e., 0.2 $\mu g/100\ cm^2$, or less), so that the cleaned equipment, apparatus, or other surface, meets the EPA guidelines for subsequent reuse, resale, or disposal as a non-hazardous material.

Further, the process allows the extraction of contaminants to a significant depth beneath a porous surface, such as concrete, brick, wood, and the like, without substantial surface destruction or scarring.

Once the desired level of decontamination has been achieved, any residual contaminants remaining in the substrate having a porous surface or surface with irregularities, may be sealed. This is achieved by applying a solution of a synthetic impermeable polymer to the surface by conventional techniques such as spraying, brushing, and the like. An especially preferred coating is provided by applying a clear polyurethane solution to the cleaned surface.

Since the process utilizes precleaning fluid, rinsing fluids, and extraction fluids, these will become contaminated with the contaminant that is being removed from the surface. These contaminated fluids must then be disposed of in an environmentally acceptable manner. To minimize disposal costs, the quantity of these contaminated fluids should be minimized. Generally, the complete invention process requires a total of 6 gallons/100 $ft^2$ of surface cleaned, more typically, less than 7–8 gallons/100 $ft^2$. Thus, the process generates a relatively low amount of hazardous waste for disposal.

b. Particulate Cleaning

The invention process and cleaning fluids are also effective for removing contaminants from particulates, such as sand, clay, gravel, and the like. Preferably, the particulates are also treated in a cycle including the steps of precleaning, rinsing with a solution of sodium citrate in ion-free water, extracting with extraction fluid, including dwelling of the fluid on particle surfaces, rinsing with a solution of sodium citrate in ion-free water, and finally drying.

There are several methods for applying these treatment steps to particulates which may be effective. However, in one of the preferred embodiments, the particulates are accumulated in a hopper from which they are fed at a controlled rate onto a conveyor belt above which is suspended a series of spraying bars from which precleaning solution is sprayed onto the contaminated particulates as the belt moves under the bars. In this manner, the particulates are intimately contacted with precleaning solution. Thereafter, the precleaned particulates are sprayed with a rinsing solution of sodium citrate in substantially ion-free water. In a next stage, the particulates are sprayed with the extraction fluid which is preferably allowed to dwell on the particulates for a period of time sufficient to penetrate pores, microscopic voids, and thoroughly clean the particulate surface. This period of time may vary depending upon the type of particulate, but is generally in the range from about 2 to about 24 hours. After dwelling, the extraction fluid is rinsed from the particulates using a solution of sodium citrate in substantially ion-free water. If, upon testing, the residual concentration of surface contaminants exceeds the level desired, the process steps may be repeated until the desired level is achieved. The rinsed particulates may then be dried by any suitable method.

In another embodiment, the invention cleaning fluids and rinsing solutions are not sprayed onto particulates on a conveyor belt, but rather, the particulates are intimately mixed with the fluids in tanks, preferably having cone-shaped bottoms. The particulate material in the tank is first sluried with precleaning fluid, preferably using an agitator rotating at low speeds to enable complete mixing and wetting of particulate surfaces. Thereafter, agitation is stopped and the particulates are allowed to settle. Precleaning solution is withdrawn and a rinsing solution of sodium citrate in substantially ion-free water is added to the precleaned particulates. Once again, the mixture of rinse solution and particulates is preferably agitated at low speeds. After rinsing, the rinse fluid is withdrawn and extraction fluid is added to the particulates, again preferably with slow agitation. After extraction has proceeded for a sufficient amount of time to remove contaminants from the particulates to a desired residual level, agitation is stopped and the cleaned particulates allowed to settle. Extraction fluid is then removed and rinse fluid is added to the particulates, preferably with agitation, to remove residual extraction fluid and contaminants from the particulate surfaces. After rinsing, the rinse fluid is removed and the particulates are discharged and conveyed to a means for drying. These means may include an oven, or may simply entail spreading the particulates in an open area for drying under sunlight and/or ambient conditions.

In certain circumstances, it may not be desirable to apply the precleaning fluid to the particulates. Under these circumstances, the extraction fluid alone may be used. Thus, in the first-described method, the particulates are sprayed with extraction fluid which is preferably allowed to dwell on the particulates for a period of time sufficient to penetrate pores, microscopic voids, and surface irregularities to thoroughly clean the particulate surface. Thereafter, the extraction fluid is rinsed from the particulates, preferably using a solution of sodium citrate in substantially ion-free water. The steps of spraying with extraction fluid, dwelling, and rinsing with sodium citrate solution are repeated until the desired residual concentration of surface contaminants is reached. In the other embodiment, particulate material is sluried with extraction fluid, preferably with agitation at low speeds. After extraction has proceeded for a sufficient amount of time to remove contaminants from the particulates, agitation is stopped and the cleaned particulates allowed to settle. Extraction fluid is then removed and rinse fluid is added to the particulates, preferably with agitation, to remove residual extraction fluid and contaminants from the particulate surfaces. Thereafter, the particulates may be discharged and conveyed to a means for drying.

Other particulate handling methods may be used to clean the particulates, as long as the above-described steps of precleaning (optional), rinsing (optional), extracting and dwelling, and rinsing are substantially followed.

The Precleaning Composition

The precleaning composition used in the invention is an aqueous fluid comprising several chemical compositions blended into substantially ion-free water. It is preferred that substantially ion-free water be used to prevent possible interference of ions typically present in water with the ions utilized by the precleaning fluid in its cleaning action.

The precleaning fluid includes compositions able to extract covalent cations from contaminated surfaces; acids that are useful as degreasers, and solubilizers of heavy metals; compositions that produce a chemical, such as hydrofluoric acid, for slightly etching the surfaces to be cleaned, including silica-containing surfaces; surfactants that act as wetting agents and that facilitate the flushing of contaminants from pores, microscopic voids, crevices, and other surface irregularities; chelating agents that fix solubilized metals and particulates into chemical complexes and that also remove stains; solvent cleaners that also act as detergents and degreasers; and optionally a composition that masks odors.

Preferably, the acid for the extracting of covalent cations, such as magnesium, calcium, and sodium, is sulfamic acid. Preferably, the composition that produces hydrofluoric acids which attacks and slightly etches surfaces to be cleaned, is hydrofluoric ammonium bifluoride. Preferably, the acid used as a degreaser is hydrochloric acid. Preferably, the surfactant is a non-ionic surfactant. More preferably, the non-ionic surfactant is polyethylene-oxylethanol. Preferably, the chelating agent of the precleaning fluid includes more than one chelant. More preferably, the chelating agents are sodium citrate and oxalic acid, the latter also acting as a stain remover, especially for iron oxide stains. Preferably, the solvent cleaner is triethanolamine which also acts as a water softener, dispersion agent, emulsifier, wetting agent, detergent, and degreaser. Optionally, an odor masking chemical may be added. Preferably, this odor masker is d-limonine which also acts as a degreaser.

Typically, the precleaning fluid comprises from about 4 to about 10 wt. % sulfamic acid, from about 5 to about 10 wt. % hydrofluoric ammonium bifluoride, from about 2 to about 4 wt. % hydrochloric acid, about 1 to about 4 wt. % of a cationic surfactant, about 8 to about 14 wt. % sodium citrate, about 10 to about 20 wt. % triethanolamine, about 2 to about 6 wt. % oxalic acid, and optionally, about 1 to about 2 wt. % d-limonine.

In a preferred embodiment, the precleaning fluid comprises about 8 wt. % sulfamic acid, about 8 wt. % hydrofluoric ammonium bifluoride, about 3 wt. % hydrochloric acid, about 3 wt. % non-ionic surfactant, about 12 wt. % sodium citrate, about 3 wt. % oxalic acid, about 10 wt. % triethanolamine, and optionally, about 1 wt. % d-limonine.

When radionuclides or heavy metals are the major contaminant, then from 1 to about 5 wt. % concentrated (36 Be/58%) nitric acid solution, and about 3 wt. % glycolic acid is added to the precleaning solution and pH is adjusted to about 0. If PCBs are the major contaminant, then the pH is preferably adjusted to about 2.5, using triethanolamine to adjust pH upward as necessary. When the contaminant is predominantly herbicides/pesticides, the pH is adjusted to about 0 using triethanolamine.

The Extraction Fluid

In order to clean any type of surface, including smooth surfaces, but especially those porous surfaces, surfaces of particulates, and irregular surfaces that are hard to clean because they retain contaminants in the substrate of the surface through the irregularities in the surface, the invention provides an extraction fluid, preferably applied to a dried surface after the precleaning fluid has been applied and vacuumed from the surface. This extraction fluid is water-based and is preferably prepared using substantially ion-free water, such as distilled water, demineralized water, and deionized water. The use of substantially ion-free water prevents the cleaning hindering interaction of ions typically present in a water supply with ions produced from the components of the extraction fluid.

The extraction fluid is a mixture of a range of components, each of which perform a function in the extraction operation. More specifically, the extraction solution includes a non-ionic or cationic surfactant; an emulsifier for emulsifying hydrocarbons from the contaminated surface; chelating agents for holding solubilized metal ions and particulates in suspension; degreasing agents for removing hydrocarbons from the contaminated surface; a hydrotrope for facilitating maintaining all ingredients in solution; and a wetting agent to facilitate wetting of the surface and pores and microscopic voids or crevices within the surface.

Preferably, the surfactant is cationic selected from the quaternary amines. Preferably, the emulsifier contains quaternary amines, isopropyl alcohol, and glycerine, preferably EMULSIFIER FOUR TM of Exxon Chemical Co., although other emulsifiers are also suitable. Preferably, the chelant comprises at least two chelating agents. More preferably, these chelating agents are selected from ethylene diamine tetracetic acid (EDTA), nitrilotriacetic acid (NTA), 1,2 diaminocyclohexane-tetracetic acid (CDTA), ethylene-bis(oxyethylene nitrilo)-tetracetic acid (EBTA), hydroxyethylenediamine (HEDTA), and sodium gluconate. Preferably, the degreaser is ethylene glycol monobutyl ether, although other degreasers may also be suitable. The hydrotrope is preferably of a type that also provides chemical buffering action to maintain pH. A preferred hydrotrope is sold under the tradename QSA-90 by Texaco Chemical Corp. A preferred wetting agent, that also serves as a solvent and degreaser is triethanolamine, although other wetting agents are also useful.

Preferably, the extraction fluid includes from about 5 to about 8 wt. % of a cationic or non-ionic surfactant; from about 4 to about 8 wt. % of an emulsifier, preferably an emulsifier containing quaternary amines, isopropyl alcohol, and glycerine; about 15 to about 20 wt. % ethylene diamine tetracetic acid; about 5 to about 10 wt. % ethylene glycol monobutyl ether; about 4 to about 8 wt. % of a chemical pH buffering agent; about 4 to about 8 wt. % triethanolamine; and about 4 to about 10 wt. % nitrilotriacetic acid, CDTA, HEDTA, EBTA, or sodium gluconate.

When it is required to remove contaminants that are predominantly radionuclides from a substrate, then the extraction fluid is preferably:

about 5 wt. % of a cationic or non-ionic surfactant; about 7 wt. % of an emulsifier, preferably one containing quaternary amines, isopropyl alcohol, and glycerine; about 10 wt. % ethylene diamine tetracetic acid; about 6 wt. % ethylene glycol monobutyl ether; about 1.5 wt. % of a chemical pH buffering agent, preferably a phosphate ester sold under the tradename QSA-90; about 20 wt. % triethanolamine; and about 6 wt. % nitrilotriacetic acid, CDTA, HEDTA, EBTA, or sodium gluconate. The pH of the fluid is preferably adjusted to about 11.5.

When the extraction fluid is required to remove PCBs or herbicides or pesticides as the predominant contaminant, then the composition is preferably as follows:

about 5 wt. % of a cationic or non-ionic surfactant; about 7 wt. % of an emulsifier, preferably one containing quaternary amines, isopropyl alcohol, and glycerine; about 10 wt. % ethylene diamine tetracetic acid; about 6 wt. % ethylene glycol monobutyl ether; about 1.5 wt. % of a chemical pH buffering agent, preferably a phosphate ester sold under the tradename QSA-90; about 10 wt. % triethanolamine; and about 6 wt. % nitrilotriacetic acid, EBTA, CDTA, HEDTA, or sodium gluconate. The pH of the fluid is preferably adjusted to the range about 7 to about 8.

When the contaminant to be removed from the substrate is predominantly of a heavy metal variety, then the extraction composition is preferably:

about 5 wt. % of a cationic or non-ionic surfactant; about 7 wt. % of an emulsifier, preferably one containing quaternary amines, isopropyl alcohol, and glycerine; about 10 wt. % ethylene diamine tetracetic acid; about 6 wt. % ethylene glycol monobutyl ether; about 1.5 wt. % of a chemical pH buffering agent, preferably a phosphate ester sold under the tradename QSA-90; about 12 wt. % triethanolamine; and about 6 wt. % nitrilotriacetic acid, CDTA, EBTA, HEDTA, or sodium gluconate. The pH of the fluid is preferably adjusted to about 10.5.

The following example is intended to illustrate the invention and does not in any way limit the invention as described above and claimed below.

EXAMPLE

During late 1992, the invention process was utilized in a test to demonstrate effectiveness by decontaminating a 3,000 sq. ft. area in an unclassified area at a nuclear weapons production plant. This area was contaminated with PCBs up to the level of 10,000 micrograms/100 $m^2$, heavy metals registering above 1,000 milligrams per liter, and enriched uranium registering above 80,000 DPM. The contaminated concrete pad was approximately 40 years old and the contaminants extended to several inches of its depth.

As a first step, the concrete pad was swept clean to remove any loose surface debris. Thereafter, a precleaning fluid of the invention was applied by scrubbing onto the surface. This precleaning fluid was then rinsed with a solution of sodium citrate in substantially ion-free water and then vacuumed. The precleaning and rinsing step was then repeated. Thereafter, the rinsed, vacuumed, and precleaned surface was allowed to dry. An invention extraction fluid was then applied to the dried, precleaned surface by scrubbing. The extraction fluid was allowed to dwell on the surface for approximately 1–3 hours, then removed by rinsing with a solution of about 8 wt. % sodium citrate in substantially ion-free water and then vacuumed. The steps of scrubbing with an extraction fluid, dwelling, rinsing off of the solution, and then vacuuming was carried out approximately 2–3 times per day for 4 days. At the end of each day, an extraction fluid was applied by scrubbing onto the surface and was allowed to dwell overnight. The following morning, the extraction fluid was rinsed off the surface with a solution of about 8 wt. % sodium citrate in substantially ion-free water and then vacuumed. Thereafter, precleaning fluid was applied by scrubbing onto the surface. The precleaning fluid was then rinsed and vacuumed from the surface and extraction fluid applied by scrubbing onto the rinsed surface. Once again, the cycle of applying extraction fluid, allowing the fluid to dwell on the surface, rinsing, and vacuuming the extraction fluid was repeated during the day. This process continued for a total of four days and three nights.

At the end of the fourth day, the weekend approached and the extraction fluid was applied by scrubbing and allowed to dwell on the surface over the 2-day weekend. The following Monday morning, the precleaning fluid was rinsed and vacuumed from the surface with a solution of sodium citrate in substantially ion-free water. The surface was then allowed to dry and samples were taken to determine the level of residual contaminant on the cleaned surface.

The results of sampling and testing indicated that residual PCBs had been reduced to less than 10 micrograms/100 $cm^2$ (in most cases, less than 0.2 micrograms/100 $cm^2$); heavy metals had been reduced to levels better than the TCLP standard set by the EPA, and radionuclides had been reduced to less than 2,000 DPM. For this particular application, the radionuclide concentration was regarded as acceptable.

The foregoing disclosure and description of the invention are illustrative and explanatory thereof, and various changes in the composition and process may be appreciated by one of ordinary skill in the art that do not depart from the scope and spirit of the invention described above and claimed below.

I claim:

1. A method for removing contaminants from surfaces and the substrates of such surfaces, including porous surfaces and surfaces with irregularities into which the contaminants may migrate or lodge, and particulate surfaces; the method comprising:

(i) precleaning the surface with an aqueous precleaning fluid comprising:

from about 4 to about 10 wt. % sulfamic acid, from about 5 to about 10 wt. % hydrofluoric ammonium bifluoride, from about 2 to about 4 wt. % hydrochloric acid, about 1 to about 4 wt. % surfactant, about 6 to about 12 wt. % sodium citrate, about 2 to about 5 wt. % oxalic acid, about 10 to about 20 wt. % triethanolamine; and, optionally, about 1 to about 2 wt. % d-limonine;

(ii) rinsing the precleaned surface with a fluid selected from the group consisting of water substantially free of ions and a solution of at least about 4 wt. % sodium citrate;

(iii) applying to the rinsed surface an aqueous extraction fluid comprising:

about 5 to about 8 wt. % surfactant, about 4 to about 8 wt. % of an emulsifier containing quaternary amines, isopropyl alcohol and glycerine, about 15 to about 20 wt. % ethylene diamine tetracetic acid, about 5 to about 10 wt. % ethylene glycol monobutyl ether, about 4 to about 8 wt. % of a chemical pH buffer agent, about 4 to about 8 wt. % triethanolamine, and about 4 to about 10 wt. % of a composition selected from the group consisting of ethylene-bis(oxyethylenenitrilo)-tetracetic acid, 1,2 diamino-cyclohexane-tetracetic acid, hydroxyethylene diamine tetracetic acid, nitrilotriacetic acid and sodium gluconate;

(iv) allowing the applied extraction fluid to dwell on the surface for a time sufficient to penetrate into pores and microscopic voids or irregularities in the surface to extract the contaminant; and (v) washing the extraction fluid from the surface and producing a cleaner surface.

2. The method of claim 1, wherein the contaminant is predominantly selected from the group consisting of polychlorinated biphenyls, herbicides and pesticides, and the precleaning fluid has a pH of about 2.5 and comprises:

about 8 wt. % sulfamic acid, about 8 wt. % hydrofluoric ammonium bifluoride, about 3 wt. % hydrochloric acid, about 3 wt. % surfactant, about 12 wt. % sodium citrate, about 3 wt. % oxalic acid, and about 10 wt. % triethanolamine.

3. The method of claim 2, wherein the extraction fluid has a pH of from about 7 to about 8 and comprises:

about 5 wt. % surfactant; about 7 wt. % of an emulsifier containing quaternary amines, isopropyl alcohol and glycerine; about 10 wt. % ethylene diamine tetracetic acid; about 6 wt. % ethylene glycol monobutyl ether; about 1.5 wt. % of a chemical pH buffer agent; about 10 wt. % triethanolamine; and about 6 wt. % of a composition selected from the group consisting of ethylene-bis(oxyethylenenitrilo)-tetracetic acid, 1,2 diamino-cyclohexane-tetracetic acid, hydroxyethylene diamine tetracetic acid, nitrilotriacetic acid and sodium gluconate.

4. The method of claim 1, wherein the step of allowing to dwell comprises allowing the extraction fluid to dwell from at least about 1 hour to about 100 hours.

5. The method of claim 1, wherein the contaminant is predominantly radionuclides and the precleaning fluid has a pH of about 0 and comprises:

about 8 wt. % sulfamic acid, about 8 wt. % hydrofluoric ammonium bifluoride, about 3 wt. % hydrochloric acid, about 3 wt. % surfactant, about 12 wt. % sodium citrate, about 3 wt. % oxalic acid, and about 15 wt. % triethanolamine; about 5 wt. % 36° Baume nitric acid solution; and about 3 wt. % glycolic acid.

6. The method of claim 5, wherein the extraction fluid has a pH of about 10.5 and comprises:

about 5 wt. % surfactant; about 7 wt. % of an emulsifier containing quaternary amines, isopropyl alcohol and glycerine; about 10 wt. % ethylene diamine tetracetic acid; about 6 wt. % ethylene glycol monobutyl ether; about 1.5 wt. % of a chemical pH buffer agent; about 5 wt. % triethanolamine; and about 6 wt. % of a composition selected from the group consisting of hydroxyethylene diamine tetracetic acid, 1,2 diamino-cyclohexane-tetracetic acid, ethylene-bis(oxyethylenenitrilo)-tetracetic acid, sodium gluconate, and nitrilotriacetic acid.

7. The method of claim 6, wherein the step of allowing to dwell comprises allowing the extraction fluid to dwell for from about 1 hour to about 100 hours.

8. The method of claim 1, wherein the contaminant is predominantly heavy metals and the precleaning fluid has a pH of about 2.5 and comprises:

about 8 wt. % sulfamic acid, about 8 wt. % hydrofluoric ammonium bifluoride, about 3 wt. % hydrochloric acid, about 3 wt. % surfactant, about 12 wt % sodium citrate, about 3 wt. % oxalic acid, and about 10 wt. % triethanolamine.

9. The method of claim 8, wherein the extraction fluid has a pH of about 11.5 and comprises:

about 5 wt. % surfactant; about 7 wt. % of an emulsifier containing quaternary amines, isopropyl alcohol and glycerine; about 10 wt. % ethylene diamine tetracetic acid; about 6 wt. % ethylene glycol monobutyl ether; about 1.5 wt. % of a chemical pH buffer agent; about 10 wt. % triethanolamine; and about 6 wt. % of a composition selected from the group consisting of nitrilotriacetic acid, ethylene-bis(oxyethylenenitrilo)-tetracetic acid, 1,2 diamino-cyclohexane-tetracetic acid, hydroxyethylene diamine tetracetic acid, and sodium gluconate.

10. The method of claim 9, wherein the step of allowing to dwell comprises allowing the extraction fluid to dwell for from about 1 hour to about 100 hours.

11. The method of claim 1, further comprising coating the cleaned surface with an impermeable synthetic polymeric coating.

12. The method of claim 11, wherein the coating comprises coating with a solution comprising polyurethane.

13. The method of claim 1, wherein when the contaminant is PCBs, the producing of a cleaned surface of step (v) comprises producing a surface having less than about 0.2 micrograms PCB/100 $cm^2$.

14. The method of claim 1, wherein a contaminant is PCBs, the producing of a cleaned surface of step (v) produces a surface having less than about 10 micrograms PCB/100 $cm^2$.

15. The method of claim 1, wherein a contaminant is radionuclides and the producing of step (v) produces a cleaned surface having a radionuclide concentration of less than 2000 DPM.

16. The method of claim 1, wherein the contaminant is selected from the group consisting of heavy metals, pesticides and herbicides and the producing of step (v) produces a cleaned surface meeting the EPA's TCLP standards.

17. A method of cleaning particulates and the surfaces of particulates of a contaminant; the method comprising:

applying to the surface an aqueous extraction fluid comprising:

about 5 to about 8 wt. % surfactant, about 4 to about 8 wt. % of an emulsifier containing quaternary amines, isopropyl alcohol and glycerine, about 15 to about 20 wt. % ethylene diamine tetracetic acid, about 5 to about 10 wt. % ethylene glycol monobutyl ether, about 4 to about 8 wt. % of a chemical pH buffer agent, about 4 to about 8 wt. % triethanolamine, and about 4 to about 10 wt. % of a composition selected from the group consisting of ethylene-bis(oxyethylenenitrilo)-tetracetic acid, 1,2 diamino-cyclohexane-tetracetic acid, hydroxyethylene diamine tetracetic acid, nitrilotriacetic acid and sodium gluconate;

allowing the applied extraction fluid to dwell on the surface for a time sufficient to penetrate into pores and microscopic voids or irregularities in the surface to extract the contaminant; and washing the extraction fluid from the surface and producing a cleaner surface.

18. The method of claim 17, further comprising before the step of applying an extraction fluid, applying a precleaning fluid comprising:

about 8 wt. % sulfamic acid, about 8 wt. % hydrofluoric ammonium bifluoride, about 3 wt. % hydrochloric acid, about 3 wt. % surfactant, about 12 wt. % sodium citrate, about 3 wt. % oxalic acid, and about 10 wt. % triethanolamine.

* * * * *

UNITED STATES PATENT AND TRADEMARK OFFICE

CERTIFICATE OF CORRECTION

PATENT NO. : 5,421,906

DATED : 06/06/95

INVENTOR(S) : BORAH

It is certified that error appears in the above-identified patent and that said Letters Patent is hereby corrected as shown below:

On the title page: Item [73], Assignee:

EnClean Environmental Services Group, Inc.

to:

EET, Inc.

Signed and Sealed this

Twenty-fourth Day of October, 1995

*Attest:*

Bruce Lehman

BRUCE LEHMAN

*Attesting Officer*

*Commissioner of Patents and Trademarks*